US010029295B2

(12) United States Patent
Holstine et al.

(10) Patent No.: US 10,029,295 B2
(45) Date of Patent: Jul. 24, 2018

(54) SYSTEM AND METHOD FOR FORMING METAL CONTAINER WITH EMBOSSING

(71) Applicant: Silgan Containers LLC, Woodland Hills, CA (US)

(72) Inventors: Rowdy H. Holstine, Hartford, WI (US); Dave Wood, Oconomowoc, WI (US)

(73) Assignee: Silgan Containers LLC, Woodland Hills, CA (US)

( * ) Notice: Subject to any disclaimer, the term of this patent is extended or adjusted under 35 U.S.C. 154(b) by 12 days.

(21) Appl. No.: 15/073,087

(22) Filed: Mar. 17, 2016

(65) Prior Publication Data

US 2016/0193647 A1 Jul. 7, 2016

Related U.S. Application Data

(63) Continuation of application No. PCT/US2013/075445, filed on Dec. 16, 2013.

(Continued)

(51) Int. Cl.
*B21D 51/26* (2006.01)
*B44B 5/00* (2006.01)

(52) U.S. Cl.
CPC ..... *B21D 51/2669* (2013.01); *B44B 5/00* (2013.01)

(58) Field of Classification Search
CPC ..... B21D 51/2669; B21D 22/26; B44B 5/00; B44B 11/04; B44B 5/0019; B21H 8/005; B41F 19/00

(Continued)

(56) References Cited

U.S. PATENT DOCUMENTS 1,561,770 A * 11/1925 Berry ..... B21D 24/12 72/329
2,177,027 A * 10/1939 Plumb ..... B21D 51/44 493/152

(Continued)

FOREIGN PATENT DOCUMENTS

JP 2000-237827 A 9/2000
JP 2001-130195 A 5/2001

(Continued)

OTHER PUBLICATIONS

International Search Report and Written Opinion regarding International application No. PCT/US2013/075445, dated Jul. 1, 2014, 10 pages.

*Primary Examiner* — Jessica Cahill
*Assistant Examiner* — Joseph Finan, Jr.
(74) *Attorney, Agent, or Firm* — Reinhart Boerner Van Deuren s.c.

(57) ABSTRACT

A system for formation of embossed indicia on the end wall of a metal food can. The system include a first die portion and second die portion opposing the first die portion. The system includes a first fastener coupled to the first die portion. The first fastener including an outer surface and a raised profile extending from the outer surface corresponding to the embossed indicia to be formed on the wall of the metal food can. The system includes a second fastener coupled to the second die portion. The second fastener includes a head portion including an inner surface and a recess formed in the head portion defined by the inner surface of the head portion. The system includes a pad of polymeric material positioned within the recess and coupled to the inner surface of the head portion.

11 Claims, 7 Drawing Sheets

Related U.S. Application Data

(60) Provisional application No. 61/891,478, filed on Oct. 16, 2013.

(58) Field of Classification Search
USPC ..... 72/414, 465.1, 466.8
See application file for complete search history.

(56) References Cited

U.S. PATENT DOCUMENTS

| | | | | | |
|---|---|---|---|---|---|
| 2,251,433 | A * | 8/1941 | Wareham | B21D 51/44 | 72/328 |
| 2,748,696 | A * | 6/1956 | Murray | B41F 17/001 | 101/379 |
| 3,063,364 | A * | 11/1962 | Kahlen | B44B 5/026 | 101/28 |
| 3,738,147 | A * | 6/1973 | Ford | B21D 51/44 | 413/8 |
| 4,450,706 | A | 5/1984 | Engelmohr | | |
| 5,046,637 | A * | 9/1991 | Kysh | B21D 51/38 | 220/610 |
| 5,272,898 | A * | 12/1993 | Dittlo | B21D 22/10 | 29/421.1 |
| 6,233,989 | B1 * | 5/2001 | Blinstrubas | B21D 28/18 | 72/325 |
| 9,873,145 | B2 * | 1/2018 | Hosoi et al. | B21D 22/26 | 72/127 |
| 2010/0251795 | A1 | 10/2010 | Brueggenbrock et al. | | |

FOREIGN PATENT DOCUMENTS

| | | |
|---|---|---|
| JP | 2012-045605 A | 3/2012 |
| WO | WO 2015/057249 | 4/2015 |

* cited by examiner

SYSTEM AND METHOD FOR FORMING METAL CONTAINER WITH EMBOSSING

CROSS-REFERENCE TO RELATED PATENT APPLICATION

This application is a continuation of PCT Application No. PCT/US2013/075445 filed Dec. 16, 2013, which claims the benefit of and priority to U.S. Provisional Patent Application No. 61/891,478 titled "SYSTEM AND METHOD FOR FORMING METAL CONTAINER WITH EMBOSSING," filed Oct. 16, 2013, which are incorporated herein by reference in their entireties.

BACKGROUND OF THE INVENTION

The present invention relates generally to the field of metal containers. The present invention relates specifically to metal containers having sunken or raised embossing, such as an embossed logo, and tools configured to form such embossing.

SUMMARY OF THE INVENTION

One embodiment of the invention relates to a system for formation of embossed indicia on the end wall of a metal food can. The system includes a first die portion having an outer surface and a second die portion having an outer surface. The second die portion opposes the first die portion, and the outer surface of the first die portion and the outer surface of the second die portion are configured to form the end wall of the metal food can. The system includes a first fastener formed from a metal material coupled to the first die portion. The first fastener includes an outer surface and a raised profile extending from the outer surface corresponding to the embossed indicia to be formed on the wall of the metal food can. The system includes a second fastener formed from a metal material coupled to the second die portion. The second fastener includes a head portion including an inner surface and a recess formed in the head portion defined by the inner surface of the head portion. The system includes a pad of polymeric material positioned within the recess and coupled to the inner surface of the head portion. The pad has an axially facing outer surface facing the raised profile of the first fastener. The system includes an actuator coupled to at least one of the first fastener and the second fastener and configured to move the first fastener and the first die portion toward the second fastener and the second die portion such that the outer surface of the first die portion and the raised portion of the first fastener engage a first surface of the end wall and that the outer surface of the second die portion and the pad of the second fastener engage a second surface of the end wall. The first fastener couples the first die section to one of the actuator or a die base, and the second faster couples the second die section to other of the actuator or the die base.

Another embodiment of the invention relates to tool for embossing indicia on a wall of a metal container. The tool includes a shaft having a longitudinal axis, a first end and a second end. The tool includes a head portion coupled to the first end of the shaft. The head portion includes a lower axially outward facing surface and an inner sidewall surface extending substantially perpendicular to and away from the lower axially outward facing surface such that the lower axially outward facing surface and the inner sidewall surface define a recess. The head portion includes an outer sidewall surface defining the outer perimeter of the head portion and an upper axially outward facing surface extending between the inner sidewall surface and the outer sidewall surface. The tool includes a pad of polymeric material positioned within the recess and coupled to the head portion.

Another embodiment of the invention relates to a method of forming embossed indicia on a wall of a metal food can. The method comprises providing a first tool coupled to a first die portion, and the die portion includes an outer surface and a raised profile extending from the outer surface corresponding to the embossed indicia to be formed on the wall of the metal food can. The method includes providing a second tool coupled to a second die portion, the second tool including a recess and a pad of polymeric material positioned within the recess. The pad has an axially facing outer surface facing the raised profile of the first tool. The method includes positioning a wall of a metal food can between the raised profile of the first tool and the pad of the second tool. The method includes engaging a first surface of the wall of the metal food can with the raised profile of the first tool and engaging a second surface of the wall of the metal food can with the pad of the second tool. The method includes applying pressure to the wall of the metal food can between the first and second tools causing the deformation of the wall of the metal food can to conform to the shape of the raised profile to form the indicia.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Figure 1:
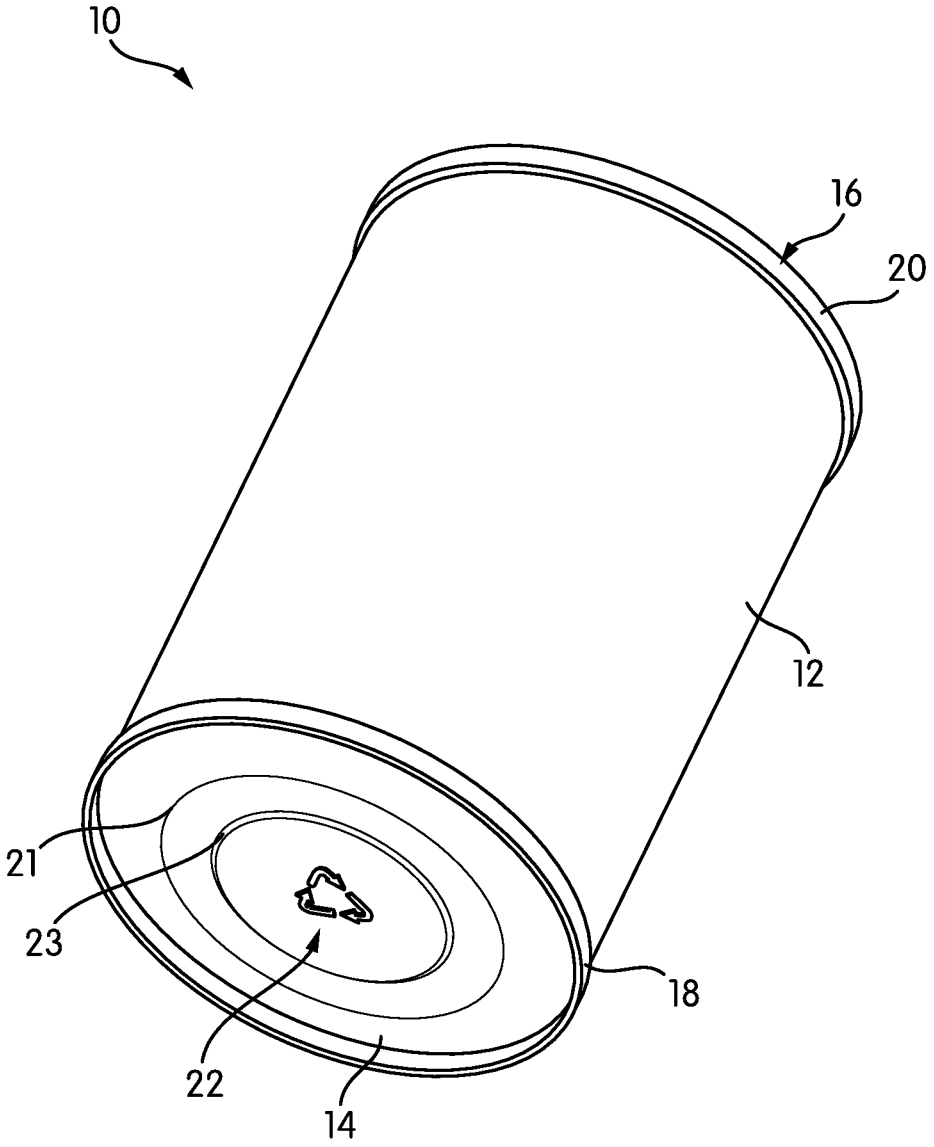
FIG. 1 is a perspective view of a can having an embossed area according to an exemplary embodiment.

Referring generally to the figures, various embodiments of a system and method for forming a metal container, such as a metal food can, that includes an embossed area, such as an embossed pattern or logo, are shown and described. In contrast to some surface pattern or logo formation techniques, such as incising, the system and method described herein forms a raised or sunken design in the metal surface of the metal container by alteration of the shape of the piece of material typically without substantial removal of material. As used herein, embossing includes both raised and sunken indicia formed in the metal container. Further, the embossing system and method is configured to create embossing even on the relatively thin metal (e.g., steel, aluminum, tinplate, etc.) that forms the sidewalls and/or end walls of commercial metal food containers.

In general, the system for forming an embossed pattern or logo includes a pair of opposing embossing tools. The first tool includes a raised profile in the shape of the pattern or logo to be formed and is formed from a strong rigid material (e.g., steel). The second tool includes a recess defined by a wall of strong rigid material and a pad of a softer or compliant material (e.g., a rubber or plastic material) positioned in the recess.

The portion of the container to be embossed (e.g., a can sidewall, a can end wall, etc.) is positioned between the first tool and the second tool, and the raised profile of the first tool is aligned with the compliant pad of the second tool. The first tool and the second tool are moved toward each other to engage a portion of the container between the tools. The raised profile of the first tool engages the portion of the container deforming it to adopt the shape of the raised profile, and at the same time, the pad of softer material engages the opposite side of the portion of the container. As the material of the container is deformed, the softer material of the pad compresses under the force of the embossing tool. Thus, the pad acts to support the portion of the container being deformed, and thereby facilitates formation of the embossing while limiting the potential of damage (e.g., cracking) of the material of the container. Further, various embodiments of the second tool discussed herein provide a tool that is robust providing extended tool life and wear resistance at speeds typical of commercial metal food can production equipment.

In various embodiments, both the upper and lower tool are fasteners, e.g., bolts, that hold together die sections configured to shape a portion of a metal food container. In one such embodiment, the die sections are configured to form contours or beads into a can end or into the integral end wall of a two piece can. In another such embodiment, the die sections are configured to form the body of a two piece can. In such embodiments, the upper and lower tools act both as embossing tools and as fasteners that hold together the respective, opposing die components. In these embodiments, by integrating the embossing tools into the fasteners that hold together components of the die, embossing is provided in synchronism with the formation of the can or can component by reducing the need for excess tooling and for a separate embossing step in the can manufacturing process.

Referring to FIG. 1, a metal container, shown as can 10, is shown according to an exemplary embodiment. Can 10 includes a sidewall 12, a first end wall, shown as bottom end wall 14 and a second end wall, shown as top end wall 16. Bottom end wall 14 is coupled to a first or lower end of sidewall 12, and top end wall 16 is coupled to a second or upper end of sidewall 12. In the embodiment shown, can 10 is a metal food can, and sidewall 12, bottom end wall 14, and top end wall 16 are formed from metal, specifically steel or aluminum. In this embodiment, bottom end wall 14 is coupled to sidewall 12 via a seam, shown as lower double seam 18, and top end wall 16 is coupled to sidewall 12 via a seam, shown as upper double seam 20. In various embodiments, double seams 18 and 20 are hermetic double seams formed from interlocked and crimped together portions of the end walls and the lower and upper ends of sidewall 12, respectively. In other embodiments, can 10 is a two piece can and one of the end walls, 14 or 16, is integral with sidewall 12.

In various embodiments, can 10 is substantially cylindrical can having a substantially cylindrical sidewall 12. In other embodiments, can 10 is a non-cylindrical can having a non-cylindrical sidewall 12. In various embodiments, can 10 is a metal food can configured to hermetically hold a food product within the can.

Can 10 includes an embossed area, shown as embossed logo 22, formed in bottom end wall 14. Embossed logo 22 is shown in FIG. 1 as the recycle logo. However, embossed logo 22 may be any logo, indicia, pattern, etc. that that can be formed via embossing in a metal material, and specifically a metal packaging material. In the embodiment shown, lower end wall 14 includes one or more concentric steps, shown as panel steps 21 and 23, and in one embodiment, embossed logo 22 is located in the center of steps 21 and 23. Further, embossed logo 22 can be formed in any portion of can 10 including sidewall 12 or top end wall 16.

Figure 2:
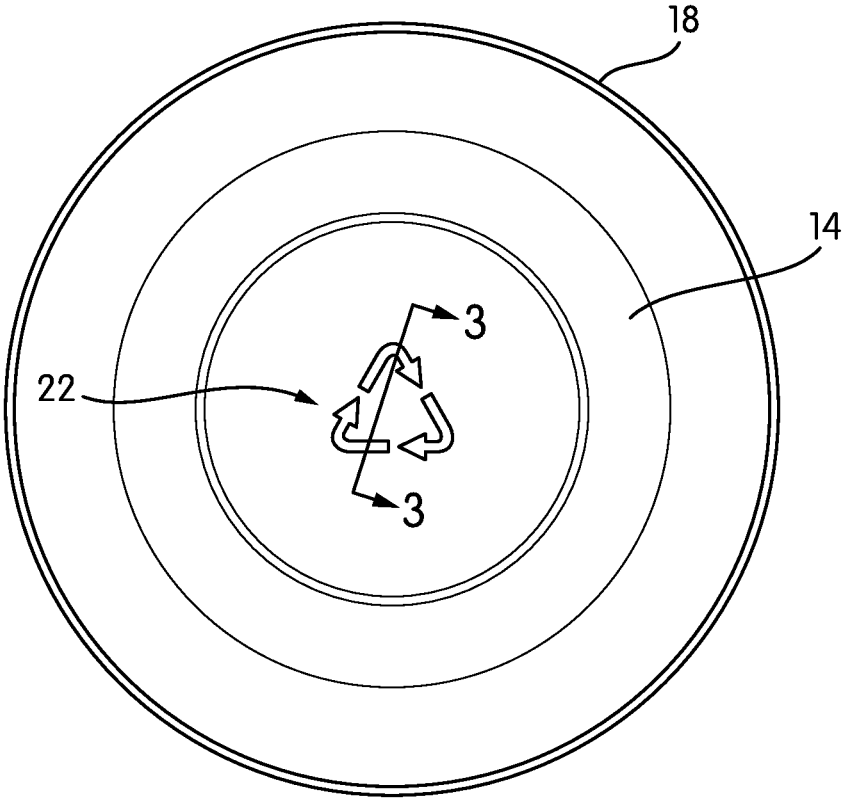
FIG. 2 is a bottom view of the can of FIG. 1 according to an exemplary embodiment.

Referring to FIG. 2 a plan view of lower end wall 14 is shown according to an exemplary embodiment. As shown logo 22 is located in the center of lower end wall 14. As shown best in FIG. 3, logo 22 is an embossed logo formed from outwardly deformed sections of end wall 14 in the shape of logo 22. Specifically, lower end wall 14 includes an inner surface 30 and an outer surface 32. Logo 22 is formed by a deformation of the material of end wall 14 such that both inner surface 30 and outer surface 32 at the position of logo 22 deflects outward or inward while the thickness of the material of end wall 14 that forms at least the majority of logo 22 is substantially the same as the thickness at the non-embossed areas.

Figure 3:
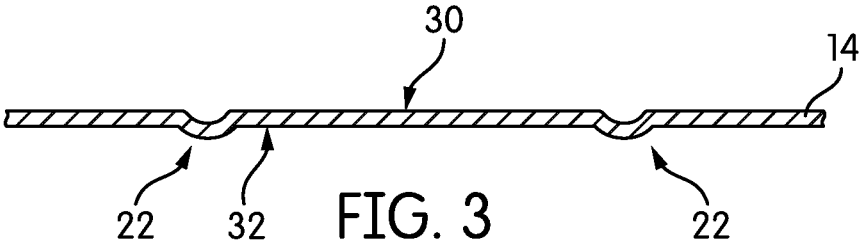
FIG. 3 is a cross-sectional view taken through the embossed area of the can of FIG. 1.

Logo 22 formed by the deformation of material as shown in FIG. 3 may provide a crisp and easy to view logo. In particular in some embodiments, the embossed logo 22 provides better viewability than logos formed by incising processes. Further, in contrast to an incising process, the thickness of end wall 14 remains substantially constant through the majority of the embossed and non-embossed areas such that logo 22 does not result in a substantially thinned or weakened portion of end wall 14. In some such embodiments, logo 22 may result in localized thinning as part of the embossing process, particularly at high radius areas such as the arrow heads of the recycle logo. While logo 22 is shown as an outwardly projecting or raised embossed logo, in other embodiments, logo 22 can be a sunken logo such that both inner surface 30 and outer surface 32 at the position of logo 22 deflects inward toward the interior of can 10.

Figure 4:
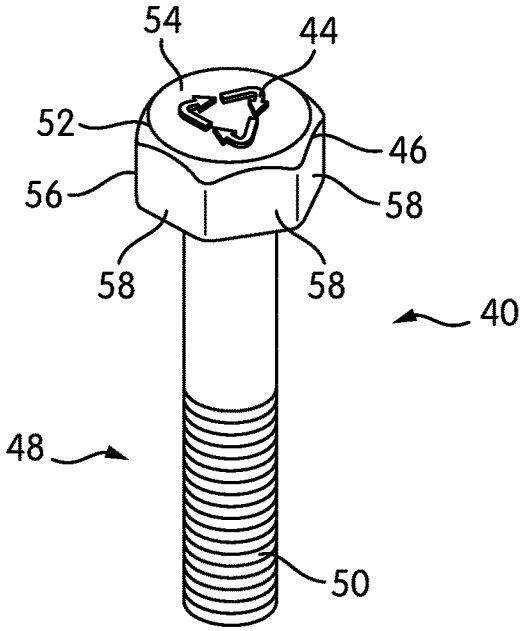
FIG. 4 is a first embossing tool according to an exemplary embodiment.
Figure 5:
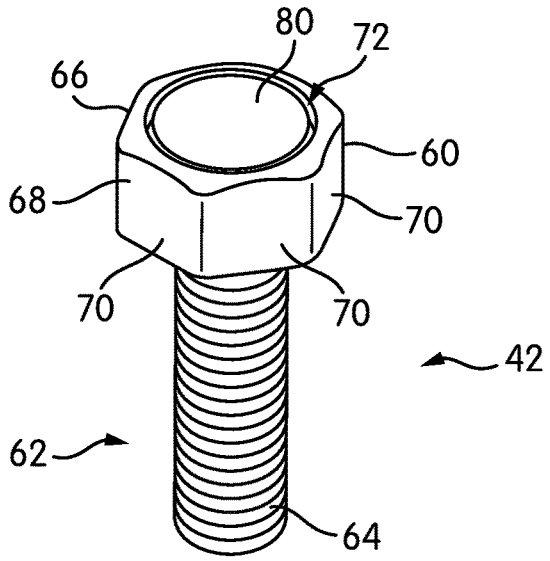
FIG. 5 is a second embossing tool according to an exemplary embodiment.

Referring to FIG. 4 and FIG. 5, a first tool, shown as upper tool 40, and a second tool, shown as lower tool 42, are shown according to exemplary embodiments. Upper tool 40 includes a raised profile 44 that is shaped in the pattern or design of embossed logo 22. In the embodiment shown in FIG. 4, upper tool 40 includes a head portion 46 and a shaft 48. Head portion 46 has a width (e.g., dimension perpendicular to the longitudinal axis of upper tool 40) greater than the width of shaft 48. Shaft 48 includes threads 50, and threads 50 are used to couple upper tool 40 to the machine used during embossing. In one embodiment, discussed in more detail below, the threads of upper tool 40 are threaded into a die, and upper tool 40 acts as a fastener that holds together the die. In one such embodiment, upper tool 40 is a bolt that holds together the upper portion of a die that forms panel steps 21 and 23 into end wall 14. In another embodiment, upper tool 40 is a bolt that holds together the upper portion of a die that forms an integral sidewall and end wall of a two piece can.

Head portion 46 includes a peripheral edge 52 and an outer surface, shown as upper surface 54, surrounded by peripheral edge 52. Upper surface 54 is substantially perpendicular to the longitudinal axis of upper tool 40 and faces away from shaft 48. Surface 54 is a substantially planar surface extending between opposing sections of peripheral edge 52. Raised profile 44 is a shaped section that extends outward from surface 54 such that the outermost surface of raised profile 44 is above surface 54 (in the orientation of FIG. 4). Shaft 48 extends from the side of head portion 46 opposite of surface 54. Head portion 46 has a sidewall 56 that extends downward and away from surface 54 at peripheral edge 52. In the embodiment shown in FIG. 4, head portion 46 is hexagonally shaped such that sidewall 56 has six faces 58.

In various embodiments, raised profile 44 extends above upper surface 54 a sufficient distance to form embossing within the relatively thin metal typical of metal food containers. In one embodiment, the height of raised profile above upper surface 54 is between 0.005 inches and 0.02 inches, specifically is between 0.005 inches and 0.015 inches, and more specifically is between 0.008 inches and 0.012 inches.

Referring to FIG. 5, lower tool 42 includes a head portion 60 and a shaft 62. Head portion 60 has width greater than the width of shaft 62. Shaft 62 includes threads 64, and threads 64 are used to couple lower tool 42 to the machine used during embossing. In one embodiment, discussed in more detail below, the threads of lower tool 42 are threaded into a die, and lower tool 42 acts as a fastener that holds together the die. In one such embodiment, lower tool 42 is a bolt that holds together the lower portion of a die that forms panel steps 21 and 23 into end wall 14. In another embodiment, lower tool 42 is a bolt that holds together the lower portion of a die that forms an integral sidewall and end wall of a two piece can.

Head portion 60 includes a peripheral edge 66 defining the outer perimeter of head portion 60. Head portion 60 has a sidewall 68. Sidewall 68 has an outer sidewall surface, shown as planar faces 70. In the embodiment shown, sidewall 68 is a continuous sidewall that extends completely around head portion 60 such that planar faces 70 face radially outward and define the outer surface or perimeter of head portion 60. In the embodiment shown in FIG. 5, head portion 60 is hexagonally shaped such that sidewall 68 has six faces 70.

Head portion 60 of lower tool 42 includes a recess 72 defined by an inner sidewall surface, shown as inner surface 74, of sidewall 68 and by a lower axially outward facing surface, shown as lower recess surface 76. Surface 76 is the upper most surface of a disc shaped bottom wall portion of head 60. Surface 76 defines the bottom surface of recess 72, and surface 74 defines that lateral surface of recess 72. In the embodiment shown, surface 74 is substantially perpendicular to surface 76 such that recess 72 is a substantially cylindrical void. However, in other embodiments, surface 74 and/or surface 76 are positioned and shaped to form voids of other shapes, e.g., cube-shaped, rectangular prism, pyramidal, etc. It should be understood that as used herein the term radial generally relates to a direction perpendicular to the longitudinal axes of the tools discussed herein. It should be further understood that positional terms, such as radial or circumferential, relate to positional relationships and do not necessarily require a circular, spherical or cylindrical shaped feature, Lower tool 42 includes a disc or pad, shown as disc 80, located within recess 72. Disc 80 is made from a compliant material that acts to support the portion of the container being embossed and thereby facilitates formation of the embossing while limiting the potential of damage (e.g., cracking) to the material of the can. In one embodiment, disc 80 is coupled within recess 72 via an adhesive material. In the embodiment shown, a lower surface of disc 80 is coupled to surface 76 via the adhesive, and a portion of the cylindrical, radially outward facing, outer surface 84 of disc 80 is coupled to inner surface 76 of head portion 60 via the adhesive. In various embodiments, disc 80 is a polyurethane material and the adhesive is a polyurethane compatible adhesive. In one embodiment, the adhesive that couples disc 80 within recess 72 is the Chemlok 218 Adhesive available from LORD Corporation.

Figure 6:
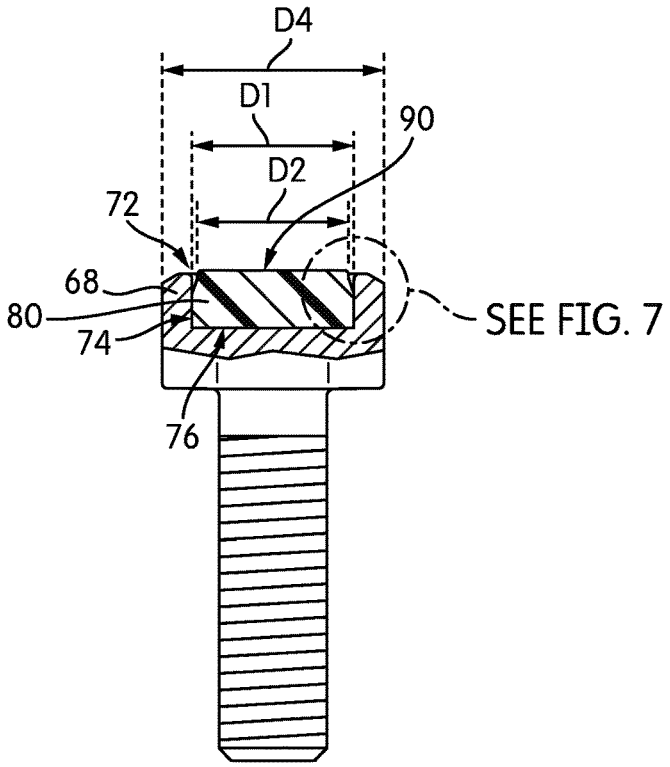
FIG. 6 is a sectional view of the second embossing tool of FIG. 5.

In various embodiments, the structure and arrangement of disc 80 within recess 72 acts to facilitate embossing of the thin metal typical in food packaging while also providing a tool that can withstand the rigors of a high throughput can manufacturing process. In various embodiments, the material of disc 80 is selected to provide sufficient wear resistance (e.g., provide an average tool life of at least 30 days) while remaining resilient (e.g., to spring back to non-compressed position as shown in FIG. 6). In various embodiments, disc 80 is formed from a polymer material, and in a specific embodiment, disc 80 is formed from a polyurethane material. In various embodiments, disc 80 is formed from a material having a Shore A scale durometer hardness of between 80 and 98, and more specifically between 90 and 95. In a specific embodiment, disc 80 is formed from a polyurethane material with a Shore A scale durometer hardness of 95.

In addition to the material of disc 80, the geometry of lower tool 42 is selected to provide increased wear resistance. In various embodiments, disc 80 is shaped such that the width of an upper portion 82 of disc 80 decreases as the distance from lower recess surface 76 increases defining an angled, radially outward facing surface, shown as angled outer surface 88. The radially inward taper of upper portion 82 of disc 80 results in a gap 86. Gap 86 is the space or void formed between the outer surface 88 of upper tapered portion 82 and the upper portion of sidewall surface 74. Gap 86 allows sufficient room for disc 80 to deform during embossing without causing excessive wear that may otherwise be caused by contact between disc 80 and sidewall 68 during embossing.

Figure 7:
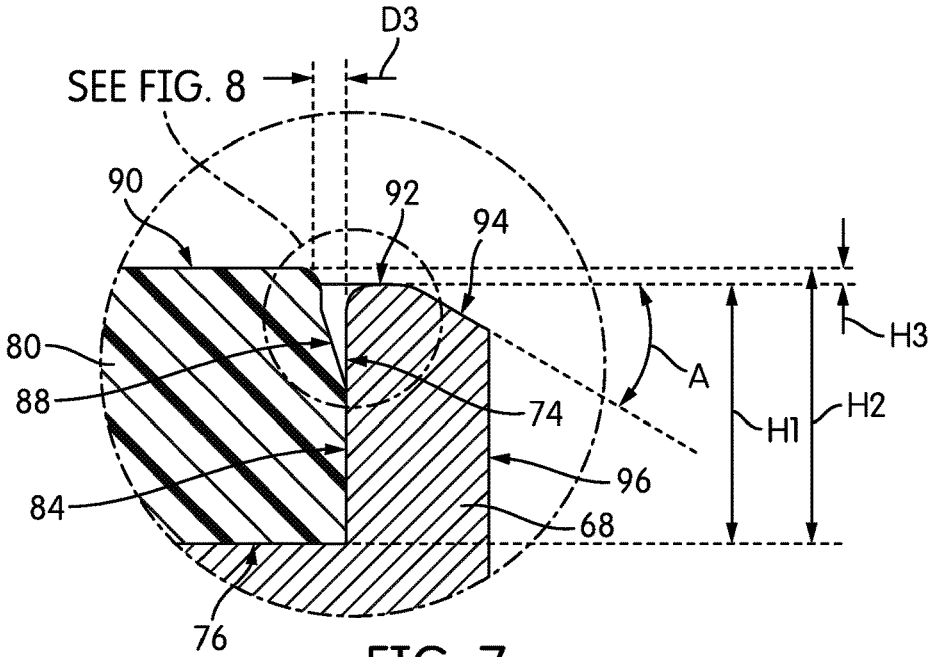
FIG. 7 is an enlarged detail view of a portion of the second embossing tool shown in FIG. 6.
Figure 8:
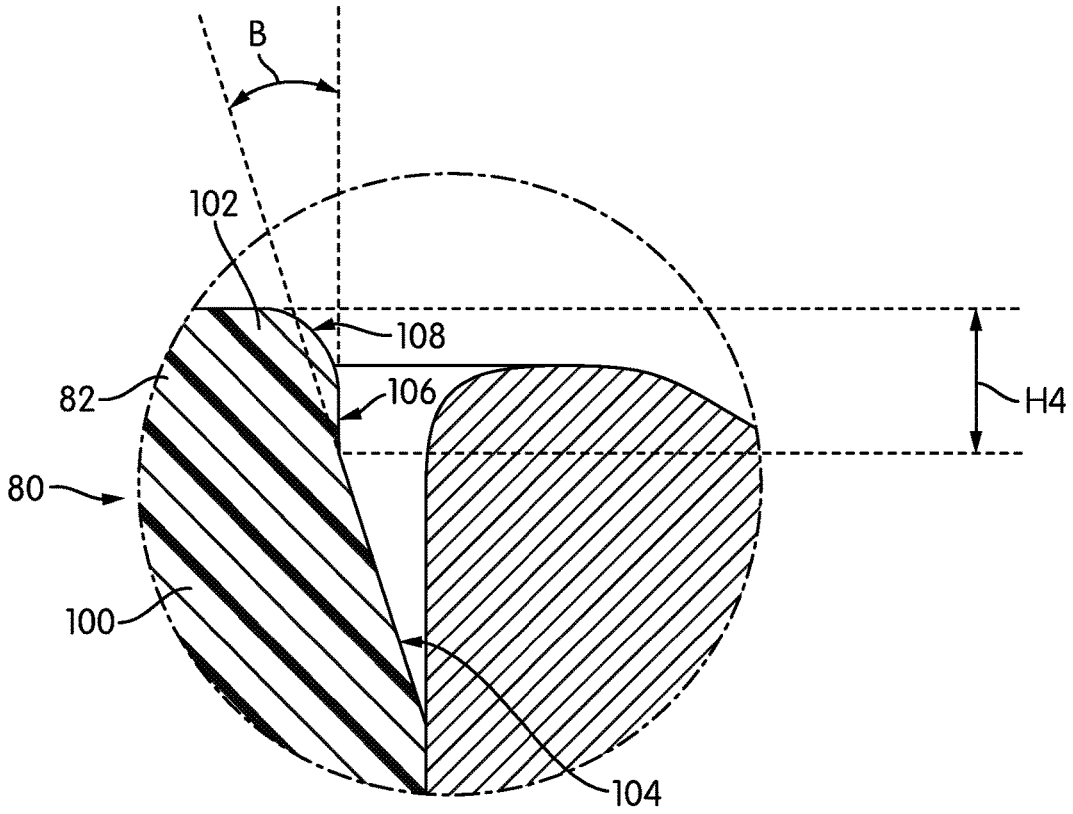
FIG. 8 is a second enlarged detail view of a portion of the second embossing tool shown in FIG. 6.

As shown in FIG. 7, disc 80 includes an upper surface, shown as axial facing uppermost surface 90. In various embodiments, recess 72 has a width, shown as diameter D1, and the uppermost surface 90 of disc 80 has a width, shown as diameter D2. In various embodiments, D2 is less than D1 such that gap 86 has a width D3 (measured between the inner diameter of inner surface 74 and outer diameter of shoulder 108). In various embodiments, D1 is between 0.5 inches and 1 inch, specifically between 0.6 inches and 0.9 inches, and more specifically between 0.8 inches and 0.9 inches. In various embodiments, D2 is between 0.4 inches and 1 inch, specifically between 0.5 inches and 0.8 inches, and more specifically between 0.65 inches and 0.75 inches. In various embodiments, D3 is between 0.01 inches and 0.05 inches and more specifically is between 0.02 inches and 0.03 inches. In one embodiment, D1 is 0.750 inches, D2 is 0.7 inches and D3 is 0.025 inches. Head portion 60 has a width, shown as outer diameter D4. In various embodiments, D4 is between 0.5 inches and 1.5 inches, specifically between 0.9 inches and 1.1 inches, and more specifically between 0.95 inches and 1.05 inches. In a specific embodiment, D4 is 1.032 inches.

Sidewall 68 of lower tool head portion 60 has an upper axially outward facing surface, shown as uppermost surface 92, an angled surface 94 and an outer sidewall surface, shown as surface 96 that defines faces 70. Uppermost surface 92 is a substantially horizontal surface surrounding recess 72, and outer surface 96 is substantially perpendicular to uppermost surface 92. Angled surface 94 extends radially outward and downward from uppermost surface 92 to join to outer surface 96 defining an angle A. In various embodiments, angle A is between 10 degrees and 50 degrees, specifically is between 20 and 40 degrees and more specifically is 30 degrees.

As shown in FIG. 7, disc 80 has a thickness or height shown as H2 that is greater than the height of sidewall 68 such that the disc 80 extends a distance H3 above uppermost surface 92 (i.e., the distance measured in the direction the longitudinal axis of the tool). Shaping disc 80 to extend above sidewall 68 provides the additional disc material to sufficiently support a portion of the can during embossing. In various embodiments, H1 is between 0.2 inches and 0.3 inches, specifically is between 0.225 inches and 0.275 inches, and more specifically is between 0.24 inches and 0.26 inches. In various embodiments, H2 is between 0.2 inches and 0.3 inches, specifically is between 0.24 inches and 0.28 inches, and more specifically is between 0.26 inches and 0.27 inches. In various embodiments, H3 is between 0.005 inches and 0.025 inches, specifically is between 0.01 inches and 0.02 inches, and more specifically is between 0.013 inches and 0.017 inches. In one embodiment, H1 is 0.25 inches, H2 is 0.265 inches, and H3 is 0.015 inches. In various embodiments, H3 is between 0.0148 and 0.0152 inches.

In various embodiments, the relative sizes of various portions of lower tool 42 provide the embossing and wear resistance geometry discussed herein. In various embodiments, D2 is between 50% and 80% of D4, specifically is between 55% and 70% of D4 and more specifically is about 64% of D4. In various embodiments, D2 is between 60% and 99% of D1, specifically is between 80% and 95% of D1, and more specifically is about 88% of D1. In various embodiments, H2 is between 101% and 120% of H1, specifically is between 101% and 110% of H1, and more specifically is about 106% of H1.

Upper portion 82 of disc 80 includes a tapered portion 100 and a substantially cylindrical portion 102 located at the upper end of tapered portion 100, and, as shown in FIG. 7, a lower cylindrical portion that defines cylindrical outer surface 84 is located below tapered portion 100. Tapered portion 100 has an angled outer surface 104, and the outer surface of cylindrical portion 102 includes a substantially vertical surface 106 and a shoulder surface 108. In general, shoulder surface 108 is a rounded shoulder that provides the transition from vertical surface 106 to the generally horizontal upper surface 90 of disc 80. In various embodiments, angled outer surface 104 defines an angle B. In various embodiments, angle B is between 5 degrees and 35 degrees, specifically is between 15 degrees and 21 degrees and more specifically is 18 degrees.

In various embodiments, cylindrical portion 102 has a height, shown as height H4. Generally, the height of cylindrical portion 102 is the height dimension of the portion of disc 80 that is above the transition between angled surface 104 and vertical surface 106. In various embodiments the height H4 of cylindrical portion 102 is between 0.01 inches and 0.1 inches, specifically is between 0.03 inches and 0.05 inches and more specifically is about 0.04 inches. In the embodiment shown, disc 80 is shaped such that it is the upper section of cylindrical portion 102 that extends above outer surface 92.

In various embodiments, the radius of curvature of shoulder surface 108 is shaped to provide improved wear resistance. In various embodiments, the radius of curvature of shoulder surface 108 is between 0.005 inches and 0.035 inches, specifically between 0.01 inches and 0.03 inches, and more specifically is between 0.015 inches and 0.025 inches.

In various embodiments, upper tool 40 and lower tool 42 are formed from steel. In a specific embodiment, upper tool 40 and lower tool 42 are formed from steel and upper tool 40 and/or lower tool 42 has a chromium nitride coating. In one embodiment, upper tool 40 has a chromium nitride coating and lower tool does not include such a coating. In one embodiment, upper tool 40 and lower tool 42 are formed from S-7 steel. In various embodiments, upper tool 40 and the body of lower tool 42 (e.g., the portions of lower tool 42 except for disc 80) are each formed from a contiguous, integral piece of metal material. In various embodiments, the outer surface of upper tool 40 and lower tool 42 are polished to a number 4 micro finish. In various embodiments, upper tool 40 and lower tool 42 are heat treated in a vacuum furnace and are triple drawn in a vacuum oven at 900 degrees to 950 degrees Fahrenheit. In one embodiment, upper tool 40 and lower tool 42 are bead blasted with 500 mesh glass beads at 40-60 psi and are polished. In addition, in one embodiment, upper tool 40 is put through a Duplex, ion chromium nitride coating process.

In the embodiments discussed herein upper tool 40 and lower tool 42 are shown as fasteners, and specifically as bolts, configured for embossing. In other embodiments, upper tool 40 and lower tool 42 may be other shapes or designs as needed.

Figure 9A:
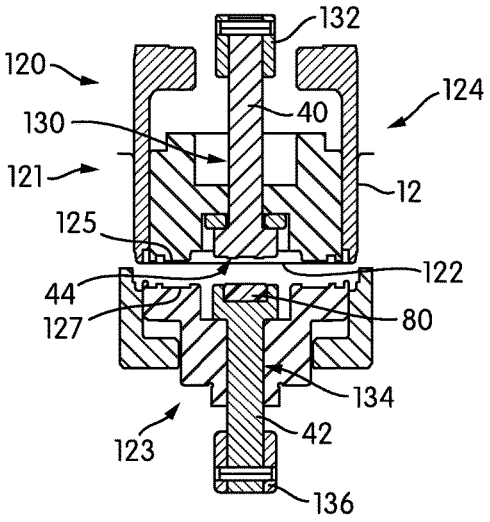
FIGS. 9A-9C show operation of an embossing system according to an exemplary embodiment.
Figure 9B:
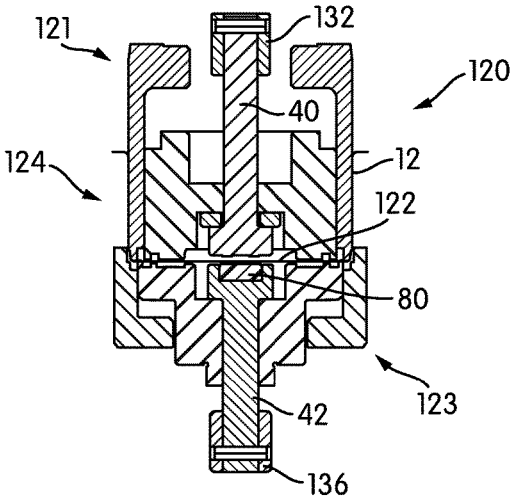
Figure 9C:
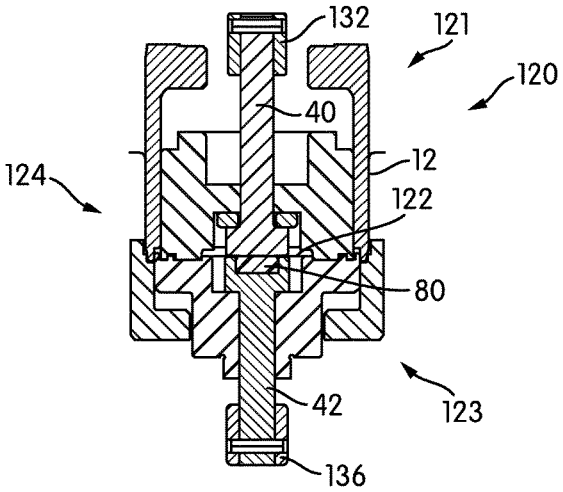

Referring to FIGS. 9A-9C, an embodiment of an embossing system in which upper tool 40 and lower tool 42 are bolts that hold together a can end or can body formation die is shown. Specifically, the system shown in FIGS. 9A-9C is a die configured to form both embossing, such as embossed logo 22, while forming a can end or can body with the same die action or stroke. In this embodiment, a die 120 is shown including an upper die portion 121 and a lower die portion 123. Upper die portion 121 has an outer surface 125, and lower die portion 123 has an outer surface 127. The outer surface 125 and 127 are shaped to form the desired shape in a can end wall 122 (e.g., the contours, steps or beads in end wall 122).

Upper die portion 121 is coupled together by upper tool 40, and lower die portion 123 is coupled together by lower tool 42. In the embodiment shown, die 120 is configured to form a can end wall 122 that is integral with a can sidewall 12, while at the same time forming embossing. In the embodiment shown, upper tool 40 is a bolt that connects upper die portion 121 to the die (e.g., by connecting to either an actuator or a die base), and lower tool 42 is a bolt that connects lower die portion 123 to the die (e.g., by connecting to either an actuator or a die base). In this embodiment, upper die portion 121 includes a channel 130, and upper tool 40 extends through channel 130 to couple to a threaded sleeve 132. In addition, lower die portion 123 includes a channel 134, and lower tool 42 extends through channel 134 to couple to a threaded sleeve 136. In this manner, upper tool 40 and lower tool 42 act as fasteners for holding together the components of die 120. It should be understood that in one embodiment, the position of upper tool 40 and lower tool 42 are reversed and in such embodiments a sunken (or debossed) logo will be formed.

Generally, die 120 includes at least one actuator coupled to either upper tool 40 or lower tool 42 that provides the movement to engage the embossing tools and the die portions with the portion of the container to be embossed. In the embodiment shown, die 120 includes an actuator 124 that is coupled to upper tool 40 and to upper die portion 121. As shown in FIG. 9A, upper tool 40 is positioned relative to lower tool 42 such that raised area 44 of upper tool 40 is aligned with disc 80 of lower tool 42, and a portion of a can, shown as can end wall 122 is positioned between upper tool 40 and lower tool 42. As shown in FIG. 9B, die 120 is operated such that actuator 124 drives upper tool 40 downward toward lower tool 42.

As shown in FIG. 9C, upper tool 40 engages an upper surface of can end 122 and lower tool 42 engages a lower surface of can end 122. In the position shown in FIG. 9C, raised area 44 of upper tool 40 engages and deforms the material of can end 122 causing it to conform to the shape of the raised profile 44 to form the indicia 22. In this position, disc 80 of lower tool 42 acts to support the material of can end 122 as can end 122 is pressed downward by upper tool 40. In the embodiment shown, the same action or stroke that forms the embossing, such as logo 22, also forms the shape, contour, steps or beads, such as end wall steps 21 and 23 shown in FIG. 1, by the engagement of the outer surfaces of die portions 121 and 123 with can end 122.

In various embodiments, embossing die 120 is a high throughput press configured to emboss and form can ends 122 or can bodies at a high rate of speed. In one embodiment, embossing die 120 is configured to go through 165 cycles per minute and to operate at temperatures of 120 degrees Fahrenheit. In specific embodiments, embossing die 120 has a stroke length (i.e., the distance that upper tool 40 travels) of approximately 7 inches.

In various embodiments, sidewall 12, lower end wall 14 and upper end wall 16 are made from metal of various thicknesses or gauges used for metal food containers. According to various exemplary embodiments, sidewall 12 is formed from metal (e.g., tinplate, stainless steel, food grade tinplate, aluminum, etc.) having a gauge range of about 0.003 inches thick to about 0.012 inches thick. In various embodiments, lower end wall 14 and upper end wall 16 are formed from metal (e.g., tinplate, stainless steel, food grade tinplate, aluminum, etc.) having a gauge range of about 0.003 inches thick to about 0.012 inches thick. In some embodiments, lower end wall 14 and upper end wall 16 are end walls of a three piece can, and in other embodiments, the can may be a two piece can and either lower end wall 14 or upper end wall 16 is integral with a sidewall of the can.

Figure 10:
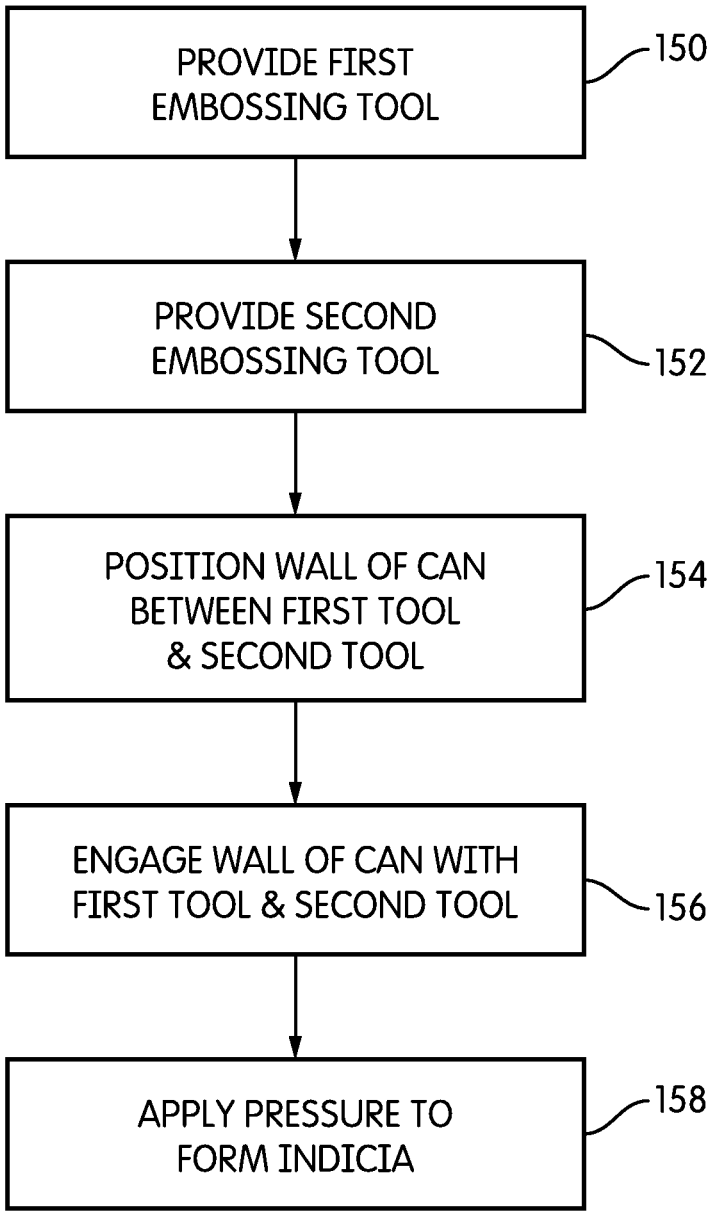
FIG. 10 is a flow-diagram showing a method of embossing a metal container according to an exemplary embodiment.

Referring to FIG. 10, a method of forming embossed indicia, such as indicia 22, on a wall of a metal container, such as end wall 14 of can 10, is shown according to an exemplary embodiment. At step 150, a first embossing tool, such as upper tool 40, is provided. At step 152, a second embossing tool, such as lower tool 42, is provided. At step 154, a wall of a metal food container, such as can end 122, end wall 14, or sidewall 12, is positioned between a raised profile of the first tool and a pad of polymeric material of the second tool. At step 156, a first surface, for example an upper surface, of the wall is engaged by the raised profile of the first tool, and a second surface, for example a lower surface, of the wall is engaged by the pad of the second tool. At step 158, pressure is applied to the wall of the metal food can between the first and second tools causing the deformation of the wall of the metal food can to conform to the shape of the raised profile to form the indicia. In various embodiments, step 158 is preformed at the same time or with the same operation that forms a can end wall or that forms beading in an end wall.

According to exemplary embodiments, the containers discussed herein are formed from metal, and specifically may be formed from, stainless steel, tin-coated steel, aluminum, etc. In some embodiments, the containers discussed herein are formed from aluminum and the can ends are formed from tin-coated steel.

Containers discussed herein may include containers of any style, shape, size, etc. For example, the containers discussed herein may be shaped such that cross-sections taken perpendicular to the longitudinal axis of the container are generally circular. However, in other embodiments the sidewall of the containers discussed herein may be shaped in a variety of ways (e.g., having other non-polygonal cross-sections, as a rectangular prism, a polygonal prism, any number of irregular shapes, etc.) as may be desirable for different applications or aesthetic reasons. In various embodiments, the sidewall of can 10 may include one or more axially extending sidewall sections that are curved radially inwardly or outwardly such that the diameter of the can is different at different places along the axial length of the can, and such curved sections may be smooth continuous curved sections. In one embodiment, can 10 may be hourglass shaped. Can 10 may be of various sizes (e.g., 3 oz., 8 oz., 12 oz., 15 oz., 28 oz, etc.) as desired for a particular application.

Further, a container may include a container end (e.g., a closure, lid, cap, cover, top, end, can end, sanitary end, "pop-top", "pull top", convenience end, convenience lid, pull-off end, easy open end, "EZO" end, etc.). The container end may be any element that allows the container to be sealed such that the container is capable of maintaining a hermetic seal. In an exemplary embodiment, the upper can end may be an "EZO" convenience end, sold under the trademark "Quick Top" by Silgan Containers Corp.

The upper and lower can ends discussed above are shown coupled to the can body via a "double seam" formed from the interlocked portions of material of the can sidewall and the can end. However, in other embodiments, the can ends discussed herein may be coupled to the sidewall via other mechanisms. For example, can ends may be coupled to the sidewall via welds or solders. As shown above, the containers discussed herein are three-piece cans having an upper can end, a lower can end and a sidewall each formed from a separate piece of material. However, in other embodiments, can 10 may be a two-piece can (i.e., a can including a sidewall and an end wall that are integrally formed and a single separate can end component joined to the sidewall via a double seam opposite the integral end wall).

In various embodiments, the upper can end may be a closure or lid attached to the body sidewall mechanically (e.g., snap on/off closures, twist on/off closures, tamper-proof closures, snap on/twist off closures, etc.). In another embodiment, the upper can end may be coupled to the container body via the pressure differential. The container end may be made of metals, such as steel or aluminum, metal foil, plastics, composites, or combinations of these materials. In various embodiments, the can ends, double seams, and sidewall of the container are adapted to maintain a hermetic seal after the container is filled and sealed.

The containers discussed herein may be used to hold perishable materials (e.g., food, drink, pet food, milk-based products, etc.). It should be understood that the phrase "food" used to describe various embodiments of this disclosure may refer to dry food, moist food, powder, liquid, or any other drinkable or edible material, regardless of nutritional value. In other embodiments, the containers discussed herein may be used to hold non-perishable materials or non-food materials. In various embodiments, the containers discussed herein may contain a product that is packed in liquid that is drained from the product prior to use. For example, the containers discussed herein may contain vegetables, pasta or meats packed in a liquid such as water, brine, or oil.

During certain processes, containers are filled with hot, pre-cooked food then sealed for later consumption, commonly referred to as a "hot fill process." As the contents of the container cool, the pressure within the sealed container decreases such that there is a pressure differential (i.e., internal vacuum) between the interior of the container and the exterior environment. This pressure difference, results in an inwardly directed force being exerted on the sidewall of the container and on the end walls of the container. In embodiments using a vacuum attached closure, the resulting pressure differential may partially or completely secure the closure to the body of the container. During other processes, containers are filled with uncooked food and are then sealed. The food is then cooked to the point of being commercially sterilized or "shelf stable" while in the sealed container. During such a process, the required heat and pressure may be delivered by a pressurized heating device or retort.

According to various exemplary embodiments, the inner surfaces of the upper and lower can ends and the sidewall may include a liner (e.g., an insert, coating, lining, a protective coating, sealant, etc.). The protective coating acts to protect the material of the container from degradation that may be caused by the contents of the container. In an exemplary embodiment, the protective coating may be a coating that may be applied via spraying or any other suitable method. Different coatings may be provided for different food applications. For example, the liner or coating may be selected to protect the material of the container from acidic contents, such as carbonated beverages, tomatoes, tomato pastes/sauces, etc. The coating material may be a vinyl, polyester, epoxy, EVOH and/or other suitable lining material or spray. The interior surfaces of the container ends may also be coated with a protective coating as described above.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

What is claimed is:

1. A system for formation of embossed indicia on the end wall of a metal food can comprising:

a first die portion having an outer surface;

a second die portion having an outer surface, the second die portion opposing the first die portion, the outer surface of the first die portion and the outer surface of the second die portion configured to form an end wall of a metal food can;

a first fastener made of a metal material coupled to the first die portion, the first fastener comprising:

an outer surface; and a raised profile extending from the outer surface of the first fastener corresponding to an embossed indicia to be formed on the wall of the metal food can;

a second fastener made of a metal material coupled to the second die portion, the second fastener comprising:

a head portion including an inner surface;

a recess formed in the head portion defined by the inner surface of the head portion, the recess defined between a lower end of the inner surface and an upper end of the inner surface; and a pad of polymeric material positioned within the recess and coupled to the inner surface of the head portion, the pad having an axially facing outer surface facing the raised profile of the first fastener and a radially facing exterior sidewall extending between a lower surface of the pad and the axially facing outer surface of the pad;

the axially facing outer surface of the pad extending beyond an axially outward most located portion of the head portion along the longitudinal axis of the second fastener;

the pad defining at least a first portion and a second portion, the first portion of the pad being spaced from the second portion along the longitudinal axis;

each of the first portion and second portion of the pad being located entirely within the recess and between the lower end of the head portion inner surface and upper end of the head portion inner surface;

a width of the first portion of the pad being greater than a width of the second portion of the pad; and an actuator coupled to at least one of the first fastener and the second fastener and configured to move one of the first fastener and the first die portion and the second fastener and the second die portion toward the other of the first fastener and the first die portion and the second fastener and the second die portion such that the outer surface of the first die portion and the raised portion of the first fastener engage a first surface of the end wall of the metal can and that the outer surface of the second die portion and the pad of the second fastener engage a second surface of the end wall.

2. The system of claim 1, wherein the second fastener further comprises a threaded shaft extending from a surface of the head portion and positioned on the opposite side of the head portion from the recess, wherein the threaded shaft couples the second fastener to the second die portion.

3. The system of claim 2, wherein the head portion of the second fastener includes a bottom wall and sidewall extending substantially perpendicular to the bottom wall, wherein the sidewall is a continuous sidewall having a radially outward facing surface defining a perimeter of the head portion, wherein the sidewall extends between the inner surface of the head portion and the outward facing surface.

4. The system of claim 3, wherein the polymeric material from which the pad is made has a Shore A scale durometer hardness between 80 and 98.

5. The system of claim 3, wherein the sidewall includes an axially facing outer surface extending between an upper end of the inner surface of the head portion and an upper end of the radially outward facing surface of the sidewall, wherein the axially outward most located portion of the head portion is defined by the axially facing outer surface of the sidewall such that the axially facing outer surface of the pad is positioned beyond the axially facing outer surface of the sidewall along the longitudinal axis of the second fastener.

6. The system of claim 5, wherein the width of the second portion of the pad is less than a width of the recess such that a gap exists between the second portion of the pad and the inner surface of the head portion.

7. The system of claim 6, wherein an axial distance between the axially facing outer surface of the pad and the axially facing outer surface of the sidewall is between 0.005 inches and 0.025 inches and the width of the gap is between 0.01 inches and 0.05 inches.

8. The system of claim 6, wherein the width of the first portion of the pad is generally the same as the width of the lower end of the recess.

9. The system of claim 7, wherein the raised portion of the first fastener is formed from steel having a chromium nitride outer coating.

10. The system of claim 2, wherein the first fastener further comprises a threaded shaft, wherein the threaded shaft couples the first fastener to the first die portion.

11. A tool for embossing indicia on a wall of a metal container comprising:

a shaft centered about a longitudinal axis, the shaft having a first end and a second end;

a head portion coupled to the first end of the shaft, the head portion comprising:

a lower axially outward facing surface;

a sidewall having an inner sidewall surface, an outer sidewall surface, and an upper axially outward facing surface, the sidewall fixedly and immovably attached to and extending outwards relative to the lower axially outward facing surface;

the inner sidewall surface extending substantially perpendicular to and away from the lower axially outward facing surface such that the lower axially outward facing surface and the inner sidewall surface define a recess;

the outer sidewall surface defining an outer perimeter of the head portion; and the upper axially outward facing surface extending between the inner sidewall surface and the outer sidewall surface; and a pad of polymeric material positioned within the recess and coupled to the head portion; and a gap extending between the inner sidewall surface of the head portion and at least a portion of an exterior radial surface of the pad;

wherein the pad includes a lower cylindrical portion, an upper cylindrical portion having a diameter less than the diameter of the lower cylindrical portion, and a tapered portion located between the lower cylindrical portion and the upper cylindrical portion, the tapered portion providing the transition from the diameter of the lower cylindrical portion to the diameter of the upper cylindrical portion.

* * * * *